United States Patent [19]

Orav et al.

[11] Patent Number: 4,825,682

[45] Date of Patent: May 2, 1989

[54] ADJUSTABLE CRIMPING TOOL

[76] Inventors: Mihkel Orav, 740 E. 345th St., Eastlake, Ohio 44094; Eugene D. Bonnes, 7855 Skyline View Dr., Mentor, Ohio 44060

[21] Appl. No.: 197,467

[22] Filed: May 23, 1988

[51] Int. Cl.[4] ..... B21D 31/00

[52] U.S. Cl. ..... 72/477; 72/317; 72/472; 72/479; 72/416; 29/751; 81/422

[58] Field of Search ..... 81/422, 424; 29/751; 72/317, 472, 473, 475, 477, 478, 479, 410, 413, 416, 409

[56] References Cited

U.S. PATENT DOCUMENTS 2,952,174 9/1960 Broske ..... 72/404

3,103,245 9/1963 Iskyan ..... 72/318

3,345,856 10/1967 Werner et al. ..... 72/410

4,144,730 3/1974 Honda ..... 72/472

FOREIGN PATENT DOCUMENTS 2648447 4/1978 Fed. Rep. of Germany ..... 72/472

*Primary Examiner*—David Jones

*Attorney, Agent, or Firm*—H. D. Gordon

[57] ABSTRACT

An adjustable crimping tool (10) is provided having a pair of indexable discs (18, 32) each of which carry a plurality of concave die cavities (18A–18F, 32A–32F) spaced about and opening to outer periphery thereof which can be moved into registry (FIG. 1) to define a selected size/shape of crimping cavity (C).

10 Claims, 3 Drawing Sheets

ADJUSTABLE CRIMPING TOOL

BACKGROUND OF THE INVENTION

1. Field of the Invention

The present invention relates to a crimping tool for crimping fittings onto the ends of flexible tubing or hose and, in particular, to a selectively adjustable crimping tool.

2. Description of the Prior Art

Tools for crimping fittings, usually fittings such as extrudable metallic connectors, connections or the like, onto the ends of flexible tubes or hoses are known in the prior art.

The prior art crimping tools were not totally satisfactory as they were not easily adjustable, if adjustable required a plurality of removable die pieces which were to difficult to remove and install onto the tool and required careful storage and/or did not allow simple radial removal of a crimped fitting/hose assembly from the tool after completion of the crimping operation (i.e. removal required the entire hose to be pulled axially through the die).

SUMMARY OF THE INVENTION

In accordance with the present invention, the drawbacks of the prior art devices have been minimized or overcome by the provision of an adjustable crimping tool which is easily adjustable, which does not utilize a plurality of removable die pieces and which allows easy removal of a crimped-on-fitting/hose assembly after the crimping operation.

The above is accomplished by providing a crimping tool comprising a relatively fixed base and a pair of index discs, each of the indexable discs rotatable about an axis parallel to the rotational axis of the other disc and parallel to and equally spaced from a flat surface defined on the base. Each of the discs carries a plurality of generally concave die cavities substantially equally circumferentially spaced about, and opening to, the outer radial periphery of the discs. Each die cavity mates with a mating cavity in the other indexable disc to define a crimping die of particular size or shape.

Means are provided to releasably lock the discs in a rotational position relative to the base such that the center lines of the selected die cavities lie on a line or plane parallel to flat surface defined on the base and containing the axes of said discs. Means are provided, such as a handle/linkage assembly, for forcing the discs towards and away from one another. In the preferred embodiment, the axis of one of the discs is fixed relative to the base and the axis of the other disc is movable along said plane toward and away from the axis of the other disc while remaining parallel thereto.

The discs are easily indexed to adjust the size and/or shape of the active mating crimping die cavities. The discs, when in a most separated position, allow a crimping-on-fitting and hose to be easily radially removed from the tool.

Accordingly, it is an object of the present invention to provide a new and improved adjustable crimping tool.

This and other objects and advantages of the present invention will become apparent from a reading of the description of the preferred embodiment taken in connection with the attached drawings.

DESCRIPTION OF THE PREFERRED EMBODIMENT

Figure 1:
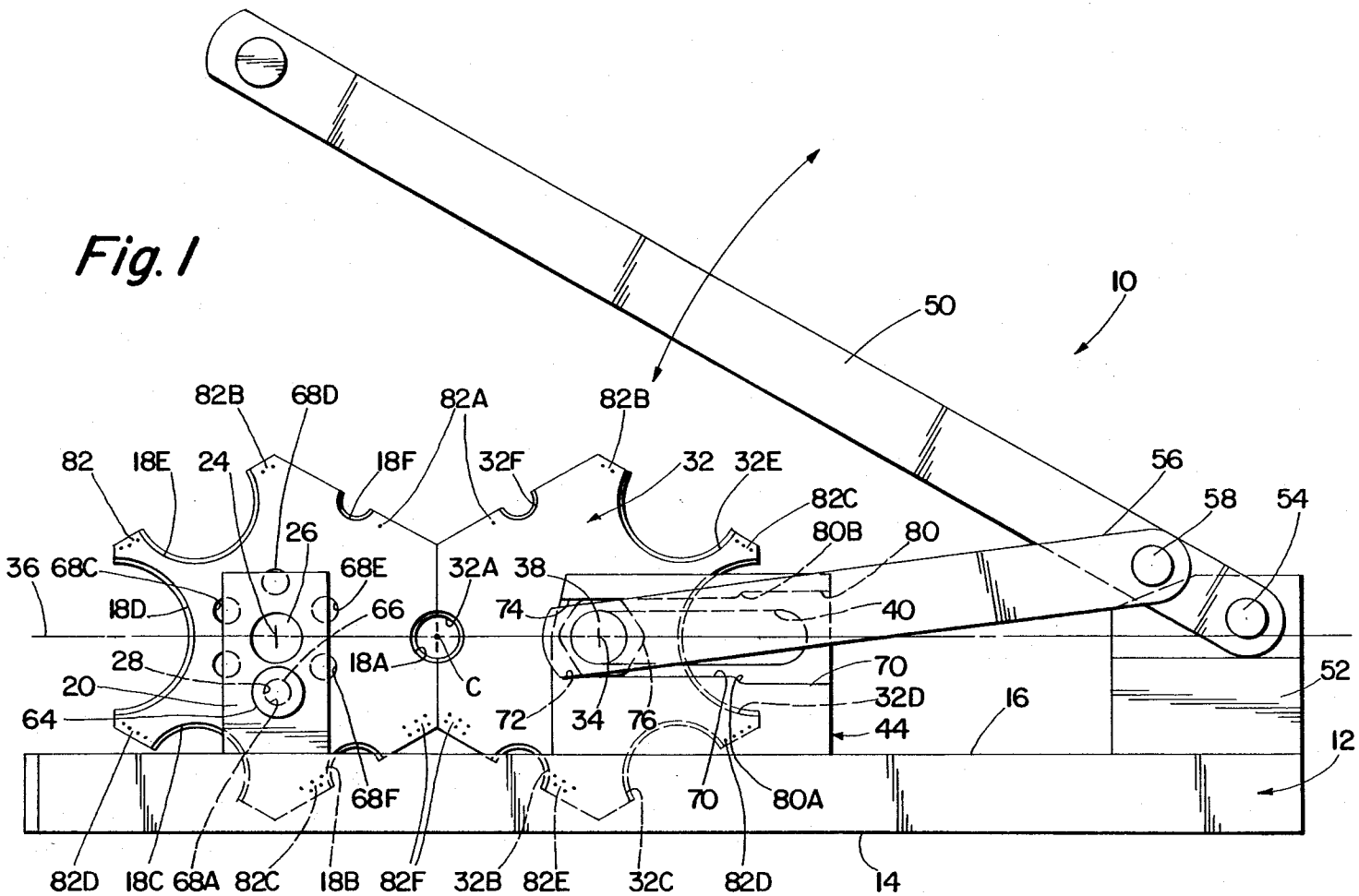
FIG. 1 is a plan view of the crimping tool of the present invention.
Figure 2:
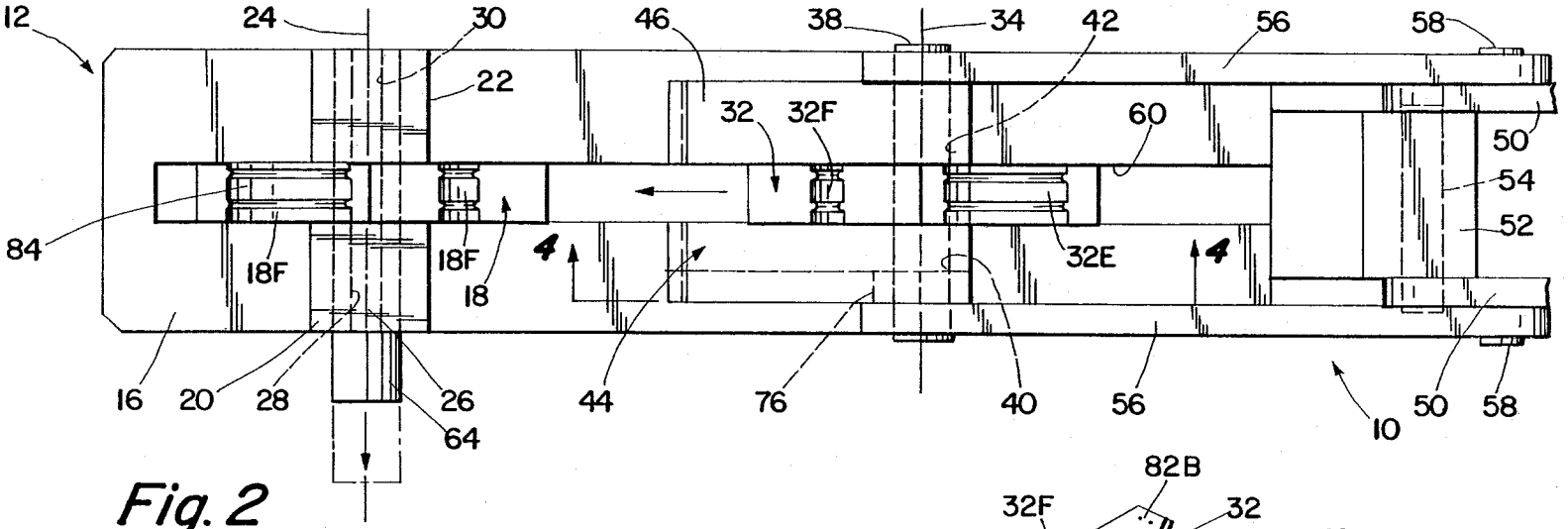
FIG. 2 is a top view of the crimping tool of the present invention.
Figure 4:
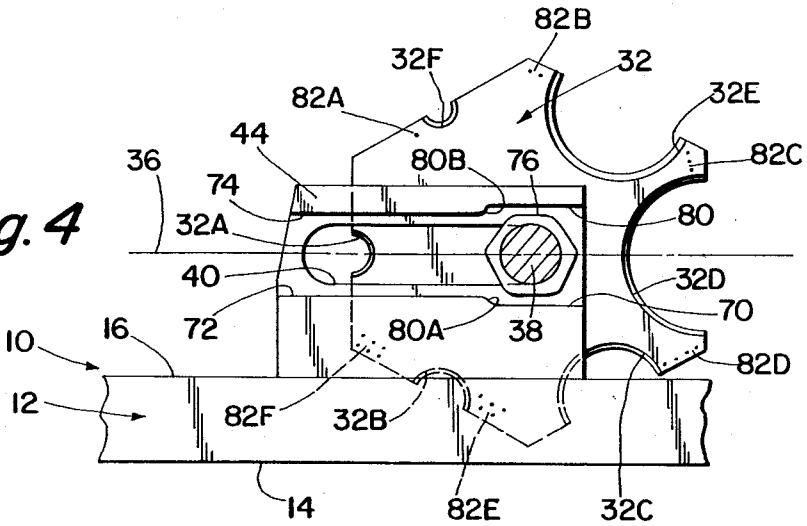
FIG. 4 is a partial sectional view taken along line 4—4 in FIG. 2.
Figure 3:
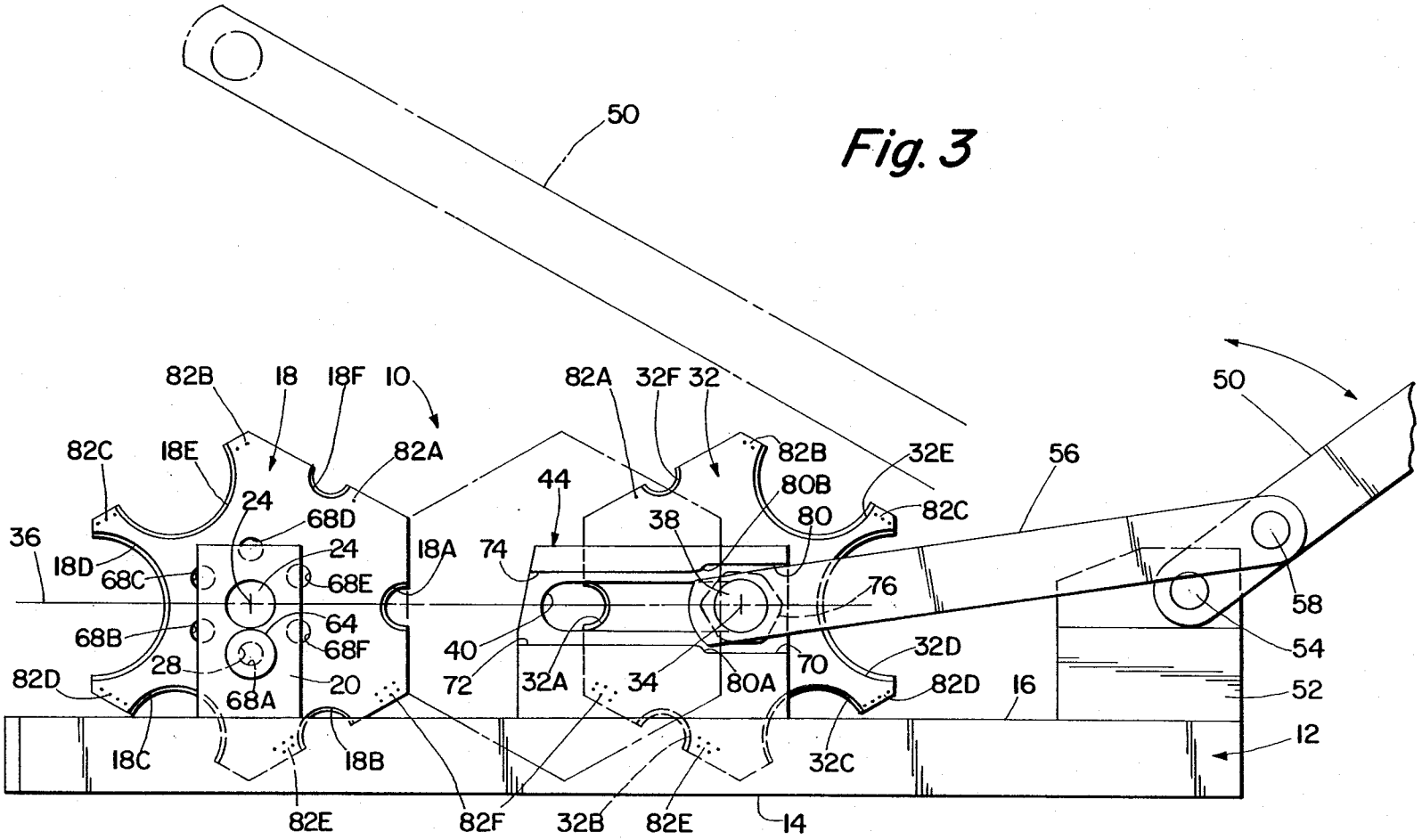
FIG. 3 of a plan view of the crimping tool of the present invention in the open position thereof.

Certain terminology will be used in the following description for convenience only and will not be limiting. The words "upwardly38, "downwardly38, "rightwardly" and "leftwardly" will designate directions in the drawings to which reference is made. The words "forward", "rearward" will refer respectively to the front and rear ends of the crimping tool being respectively from the left and right side of the tool as illustrated in FIG. 1. The words "inwardly" and "outwardly" will refer to directions toward and away from, respectively, the geometric center of the device and designated parts thereof. Said terminology includes the words above specifically mentioned, derivatives thereof and words of similar import.

The adjustable crimping tool 10 of the present invention may be seen by reference to FIGS. 1–4.

Crimping tool 10 comprises a relatively stiff, robust base portion 12 defining a relatively flat lower surface 14 and parallel upper surface 16.

A first, axially fixed indexing die cavity disc 18 is supported by strut members 20 and 22 which extend upwardly from surface 16 of base 12 for rotation about an axis 24 which extends generally parallel to surface 16. Disc 18 is supported by a pivot pin 26 received in aligned bores 28 and 30 in the struts 20 and 22, respectively.

Disc 18 and substantially identical second indexing die cavity disc 32 are substantially equilateral hexagons having substantially semi-circular concave die cavity halves 18A, 18B, 18C, 18D, 18E and 18F, and 32A, 32B, 32C, 32D, 32E and 32F, respectively, substantially equal circumferentially spaced about, and opening to, the radially outer peripheries thereof. Die cavity concave cavity halves 18A–32A, 18B–32B, 18C–32C, 18D–32D, 18E–32E and 18F–32F are matable to form crimping dies of selective size and/or shape.

Die cavity disc 32 is rotatable about a rotational axis 34 extending generally parallel to rotational axis 24. Both axes 24 and 34 are equally spaced from surfaces 16 and 14 to define a plane 36 generally parallel to surfaces 16 and 14.

Die cavity disc 32 is supported on a pivot pin 38 which is slidably and rotatably supported in axially extending slots 40 and 42 provided in elongated strut members 44 and 46, extending upwardly from surface 16 of base 12. Slots 40 and 42 are parallel with and centered upon plane 36 defined by the axes 24 and 34.

A handle and linkage assembly comprising a handle 50 pivoted to base 12 at strut 52 by a pivot pin 54 and a link pair 56 pivoted to the handle 50 by pivot pin 58 at one end thereof and pivotably receiving pivot pin 38 at the other end thereof is provided for forcing disc 32 toward and away from disc 18.

An elongated slot 60, perpendicular to axes 24 and 34, is provided in base 12 to allow rotation of disc 18 and rotation and axial movement of disc 32 relative to base 12.

For proper crimping action, the discs must be rotationally fixed during the crimping operation so that the selected die cavity halve pairs, i.e. the axially inwardmost of the cavities on discs 18 and 32, are properly matched and the center lines of the cavities lie on plane 36.

Indexing of disc 18 is accomplished by a set pin 64 receivable in a bore 66 in struts 20 and/or 22 and a selected bore of bores 68A, 68B, 68C, 68D, 68E or 68F in disc 18.

Bores 66 and 68A will align when disc 18 is aligned with the center line of cavity 18A on plane 36. Similarly, bore 66 will align with bores 68B, 68C, 68D, 68E or 68F, respectively, when the disc 18 is positioned with cavity half 18B, 18C, 18D, 18E or 18F, respectively having a center line on plane 36.

In strut 44, a second, enlarged slot 70 having parallel upper and lower surfaces 72 and 74, centered about and parallel to plane 36 is provided. Pivot pin 38 is provided with a flat sided portion 76, similar to a hex nut, having opposite pairs of flat surfaces which will align with surfaces 74 and 76 and allow member 76 to slide in slot 70 only if disc 32 is properly rotationally aligned with one of its cavity halves having its center line on plane 36. Slot 70 has an enlarged portion 80, with ramps to surfaces 72 and 74, allowing rotation of disc 32 when the disc 32 is in the retracted position (see FIG. 3) with member 76 received in portion 80.

To assist with properly matching die cavity halves, the discs 18 and 32 may be provided with matching indicia marks, such as marks 82A, 82B, 82C, 82D, 82E and 82F which will align when matching or mating die cavity halves are properly positioned. The indicia marks may vary in shape, color, number and/or may be alpha-numeric.

In operation, after a metallic, extrudable fitting is placed over the end of a length of flexible tube or hose, the discs 18 and 32 are positioned so that the properly sized die cavities are in the inward crimping position (position of cavity 18A and 32A in FIG. 1). To adjust disc 18, pin 64 is removed, disc 18 rotated to correct position and pin 64 re-inserted into bore 66 and the aligned bore 64A–64F. The handle 50 is moved rightwardly to open the tool (see FIG. 3) which will move member 76 into enlarged portion 80 of slot 70, allowing the disc to be properly positioned. The interaction of flat surfaces of member 76 and surfaces 72 and 74 will assure that disc 32 is properly aligned.

The fitting and tube end will then be positioned in cavity half, 18A–18F, and the handle 50 moved leftwardly to cause the matching cavity half, 32A–23F, to be forced leftwardly to compress and extrude the fitting onto the hose or fitting. Preferably the cavity halves will be provided with raised ribs 84 to improve the crimped connection of the fitting to the tube or hose.

Accordingly, it may be seen that a relatively simple, easily used and adjustable crimping tool is provided.

Although the present invention has been described with a certain degree of particularity, it is understood that the description of the preferred embodiment is by way of example only and that various modification and rearrangement of the parts may be resorted to without departing from the spirit and scope of the invention as hereinafter claimed.

I claim:

1. An adjustable crimping tool (10) for crimping fittings onto the ends of flexible tubes, said tool comprising:

a base member (12);

first (18) and second (32) substantially identical die cavity discs, each of said discs defining a plurality of different size/shape generally semicircular die cavities (18A–F, 32A–F) circumferentially spaced about and opening to the outer periphery of said discs;

means (20, 22, 44, 46) for supporting said discs on said base for rotation about the rotational axes (24, 34) thereof, said supporting means maintaining said rotational axes in a parallel relationship;

means (50, 56) for causing relative movement of said discs in a direction (36) perpendicular to said rotational axes from a first position (FIG. 3) of separation to a second position (FIG. 1) wherein opposing portions of the discs are in substantially abutting relationship with one die cavity on each disc in substantial registration with a die cavity on the other disc to define a crimping cavity (C) therebetween; and indexing means (64, 76) for releasably retaining each of said discs in a rotational position relative to said base such that said one die cavity is positioned with the point about which it is concave lying substantially on the plane defined by said rotational axes, said indexing means comprising a polygonal member (76) fixed for rotation with said second disc (32) and having opposed pairs of parallel flat surfaces which will slidably engage with parallel flat surfaces (72, 74) defined by said second support means (44, 46) and extending parallel to said plane (36) only when said second disc is rotationally positioned with the point about which one of die cavities therein (32A–F) is concave is lying substantially on said plane (36).

2. The tool of claim 1 wherein, in said first position, said discs are separated by distance greater than the diameter of the largest crimping cavity defined by any of said requestering die cavities.

3. The tool of claim 2 wherein said means for causing relative movement are manually operated.

4. The tool of claim 3 wherein said means for causing relative movement comprises a handle and linkage mechanism.

5. The tool of claim 2 wherein said supporting means comprise a first strut means (20, 22) fixed to said base having a bore (28, 30) for receipt of first pivot pin (26) fixed to said first disc (18) and second strut means (44, 46) defining a slot (40) for receipt of a second pivot pin (38) fixed to said second disc (32), said slot extending in a direction parallel to and centered about the plane (36) defined by said rotational axes (24, 34).

6. The tool of claim 4 wherein said supporting means comprise a first strut means (20, 22) fixed to said base having a bore (28, 30) for receipt of first pivot pin (26) fixed to said first disc (18) and second strut means (44, 46) defining a slot (40) for receipt of a second pivot pin (38) fixed to said second disc (32), said slot extending in a direction parallel to and centered about the plane (36) defined by said rotational axes (24, 34).

7. The tool of claim 6, wherein said handle and linkage mechanism includes a link member (56) having a bore for receipt of said second pivot pin.

8. The tool of claim 1 wherein said die cavities are substantially equally circumferentially spaced about the outer periphery of said discs.

9. The tool of claim 8 wherein said discs are substantially equilateral polygons in cross section, said cavities being centered in the flat surfaces defining the outer periphery of said discs.

10. The tool of claim 1 wherein said indexing means comprises removable pin means (64) for locking said first disc in one of a plurality of selectable rotational positions relative to said base.

* * * * *